US007381167B2

(12) United States Patent
Duhamel

(10) Patent No.: US 7,381,167 B2
(45) Date of Patent: Jun. 3, 2008

(54) DUMBBELL WITH ANGLED BAR

(76) Inventor: François Duhamel, 109, James, Cowansville, Quebec (CA) J2K 2L1

( * ) Notice: Subject to any disclaimer, the term of this patent is extended or adjusted under 35 U.S.C. 154(b) by 47 days.

(21) Appl. No.: 11/169,035

(22) Filed: Jun. 28, 2005

(65) Prior Publication Data

US 2006/0003876 A1 Jan. 5, 2006

Related U.S. Application Data

(60) Provisional application No. 60/584,332, filed on Jul. 1, 2004.

(51) Int. Cl.
*A63B 21/072* (2006.01)

(52) U.S. Cl. ..... 482/108; 482/139

(58) Field of Classification Search ..... 482/44, 482/92–94, 98, 139, 104–109, 141
See application file for complete search history.

(56) References Cited

U.S. PATENT DOCUMENTS

| | | | | |
|---|---|---|---|---|
| 460,270 | A | 9/1891 | Somerby | |
| 1,013,782 | A | 2/1912 | Koch | |
| 2,508,567 | A | 5/1950 | Dymek | |
| 2,722,419 | A | 11/1955 | Tarapczynski | |
| D197,899 | S | 4/1964 | Sutcliffe | |
| 4,288,073 | A | 9/1981 | Patrachonis et al. | |
| 4,369,968 | A * | 1/1983 | Price | 482/106 |
| D279,495 | S | 7/1985 | Barbeau | |
| 4,531,729 | A | 7/1985 | Wrinkle | |
| 4,605,222 | A | 8/1986 | Shannon | |
| 4,768,780 | A | 9/1988 | Hayes | |
| 4,867,444 | A * | 9/1989 | Castillo | 482/106 |
| 4,903,962 | A | 2/1990 | Pollack | |
| D318,700 | S * | 7/1991 | Davis | D21/681 |
| 5,221,244 | A * | 6/1993 | Doss | 482/106 |
| 5,399,135 | A | 3/1995 | Azzouni | |
| 5,421,797 | A * | 6/1995 | Fletcher | 482/106 |
| D362,880 | S | 10/1995 | Biezek | |
| D398,676 | S * | 9/1998 | Marney | D21/681 |
| D405,484 | S | 2/1999 | Rojas | |
| 6,099,443 | A | 8/2000 | Landfair | |
| 6,120,420 | A | 9/2000 | Pearson et al. | |
| D434,813 | S | 12/2000 | Anderson | |
| 6,228,003 | B1 * | 5/2001 | Hald et al. | 482/107 |
| D444,516 | S | 7/2001 | Pearson et al. | |
| 6,261,022 | B1 * | 7/2001 | Dalebout et al. | 482/107 |
| 6,387,021 | B1 * | 5/2002 | Miller, Jr. | 482/99 |
| 6,406,409 | B1 * | 6/2002 | Silver | 482/104 |
| 6,488,613 | B1 | 12/2002 | Domengue | |
| 6,602,170 | B2 * | 8/2003 | Ilic | 482/132 |
| 7,090,625 | B2 * | 8/2006 | Chermack | 482/108 |
| 2004/0162198 | A1 * | 8/2004 | Towley et al. | 482/107 |

* cited by examiner

*Primary Examiner*—LoAn H. Thanh
*Assistant Examiner*—Victor K. Hwang

(57) ABSTRACT

A dumbbell having a bar that is set non perpendicularly to the weights of the dumbbell and has added features such as indicias that a user can quickly see in order to know which direction the dumbbell is for appropriate grasping as well as footings which orient the dumbbell so as to make it easy to use. Since the bar reorients the weights so that they do not interfere with the body, a shorter bar can be used which brings each weight closer to the other.

10 Claims, 4 Drawing Sheets

DUMBBELL WITH ANGLED BAR

Figure 1A:
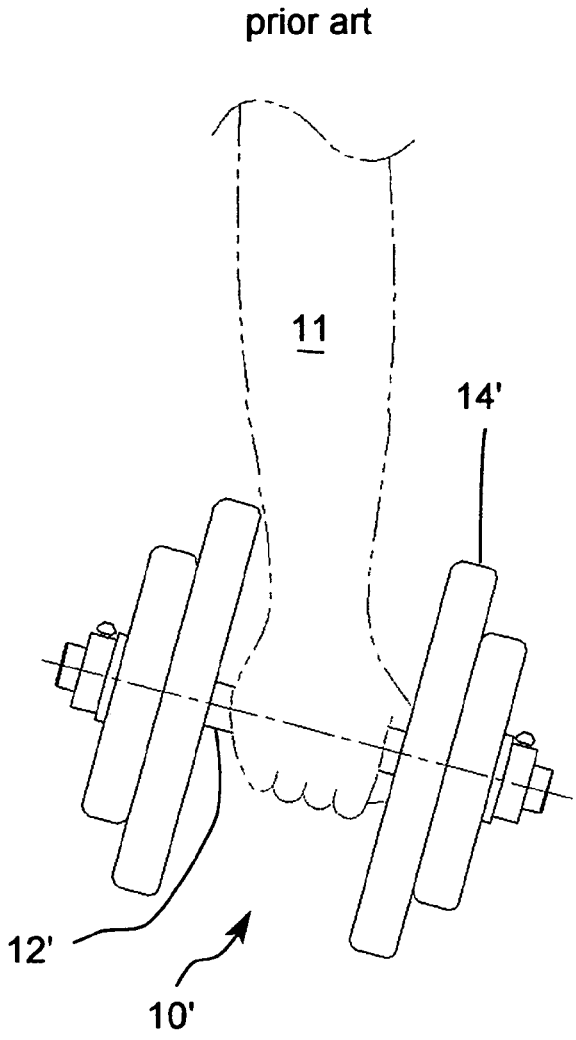

This application claims priority based on provisional application 60/584,332 filed Jul. 1, 2004

BACKGROUND OF THE INVENTION

1. Field of the Invention

The invention relates generally to sports equipment but more particularly to a dumbbell having an angled bar to favor motion by a user.

2. Background of the Invention

Dumbbells have been around for centuries, but with the ever increasing variety of exercise moves being created, some flaws in the design of current dumbbells are beginning to show. Due to body configuration, more particularly in the way hands grab dumbbells, some moves are awkward or have the weights of the dumbbell interfere with body motion because of the way the hand has to grasp the bar between the weights.

Some effort has been made in that direction by having handles incorporated along or as replacement to the bar between the weights such as in U.S. Pat. No. 460,270, U.S. Pat. No. 734,062 and U.S. Pat. No. 1,917,566.

Also, but more specifically for barbells, kinks have been incorporated in the bar such as in U.S. Pat. No. 2,508,567, U.S. Pat. No. 2,722,419, U.S. Pat. No. 4,288,073. Also, the use of an offset bar is disclosed in U.S. Pat. No. 4,288,073.

SUMMARY OF THE INVENTION

In view of the foregoing disadvantages inherent in the known devices now present in the prior art, the present invention, which will be described subsequently in greater detail, is to provide objects and advantages which are:

To have a dumbbell that does not interfere with the body or with body motion.

To have a dumbbell that fits ergonomically.

To have a dumbbell that is easy to use.

To have a dumbbell with a shorter bar.

To attain these ends, the present invention generally comprises a bar that is set non perpendicularly to the weights of the dumbbell and has added features such as indicias that a user can quickly see in order to know which direction the dumbbell is for appropriate grasping as well as footings which orient the dumbbell so as to make it easy to use. Since the bar reorients the weights so that they do not interfere with the body, a shorter bar can be used which brings each weight closer to the other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE PREFERRED EMBODIMENT

FIG. 1*a* Side view of the prior art with user arm.

Figure 1B:
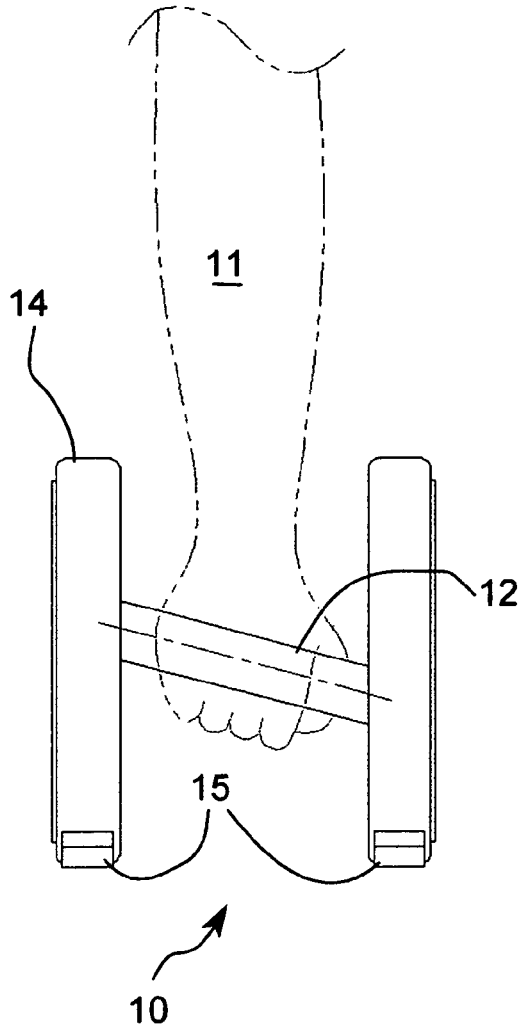

FIG. 1*b* Side view of this invention with user arm.

Figure 2:
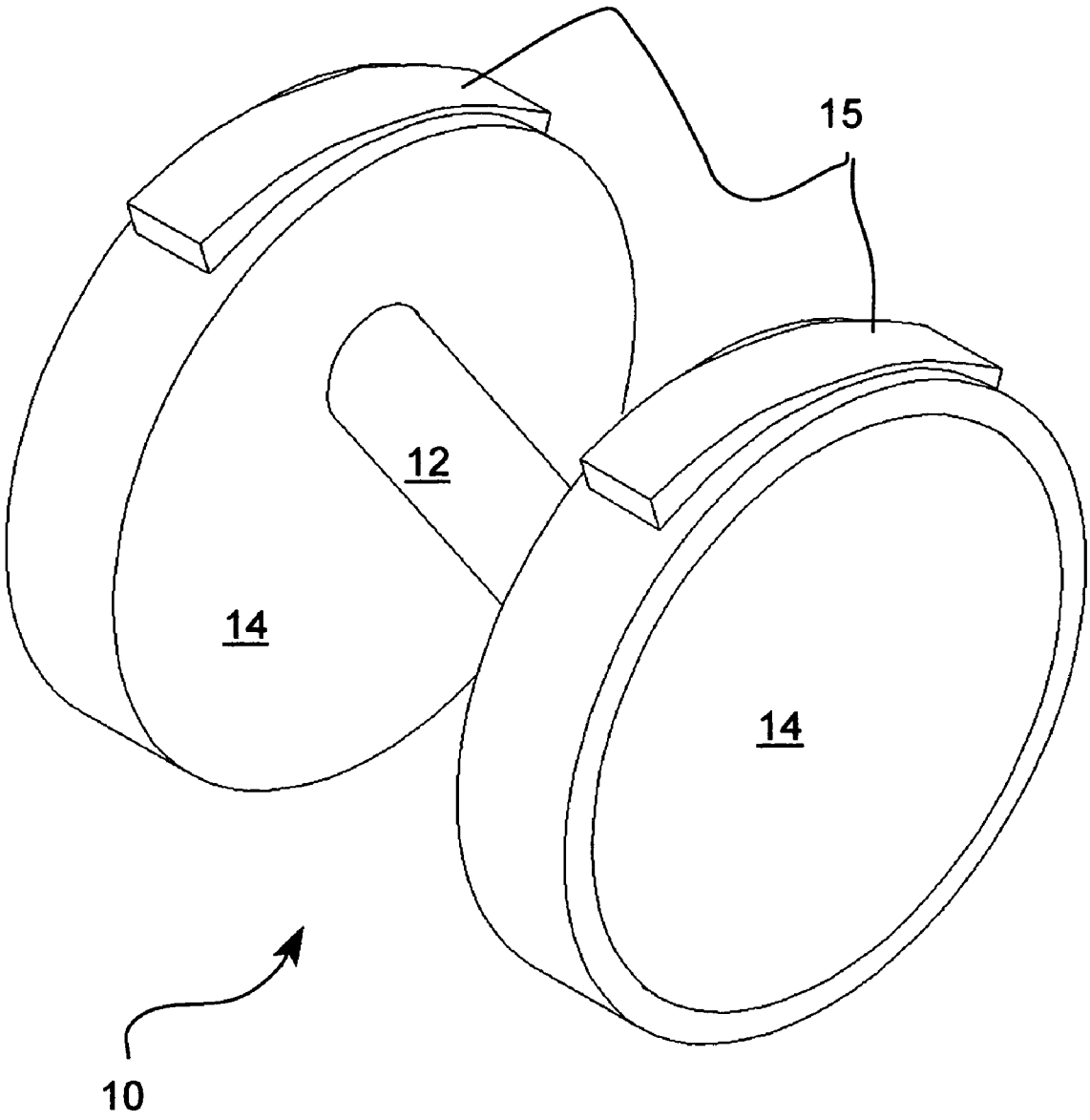

FIG. 2 Isometric view of the invention.

Figure 3A:
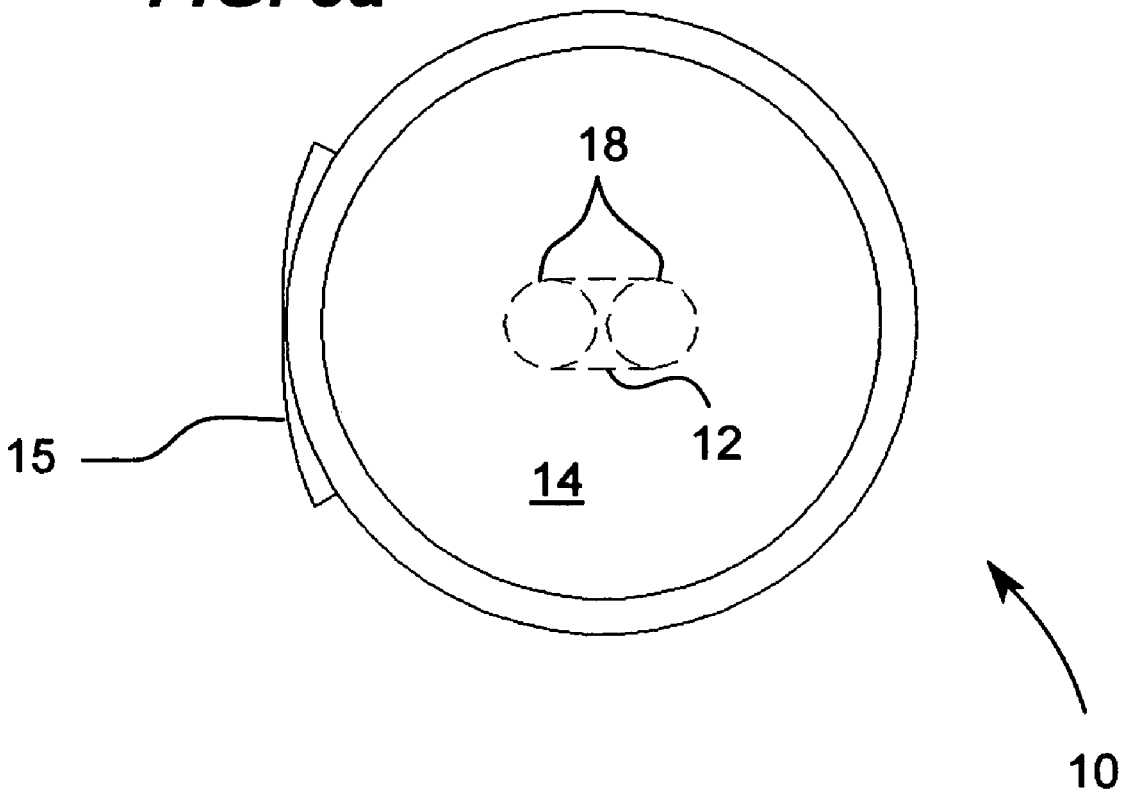

FIG. 3*a* Side view of the invention.

Figure 3B:
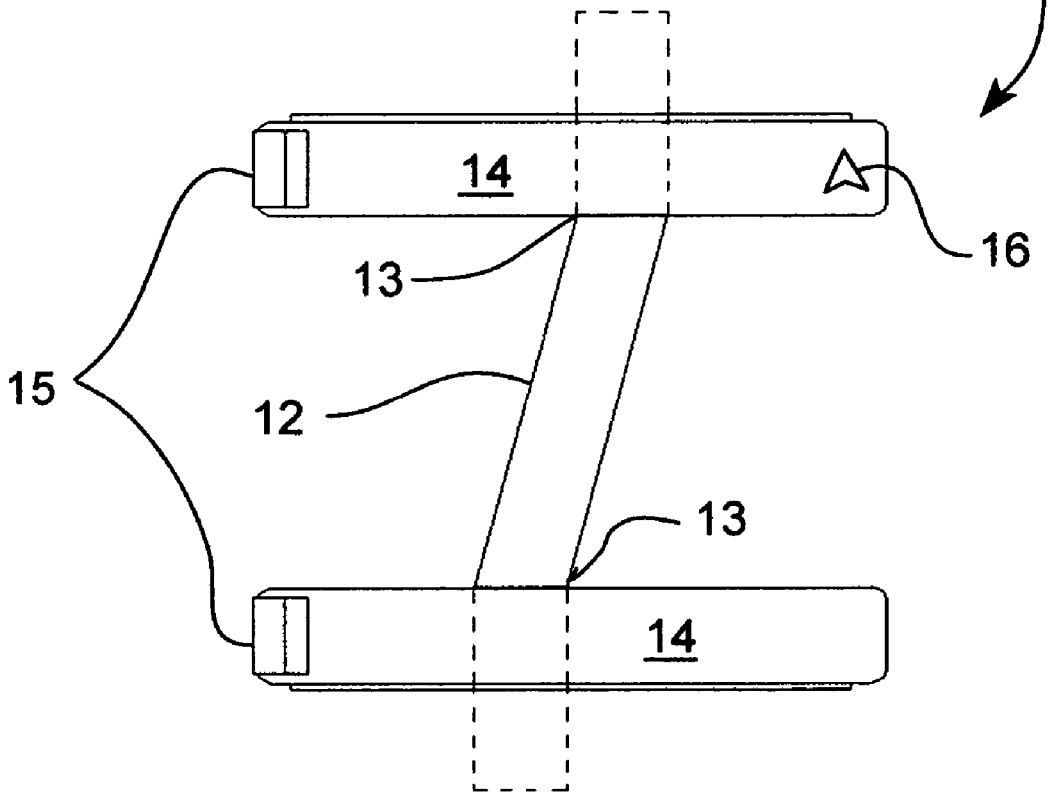

FIG. 3*b* Front view of the invention.

Figure 4A:
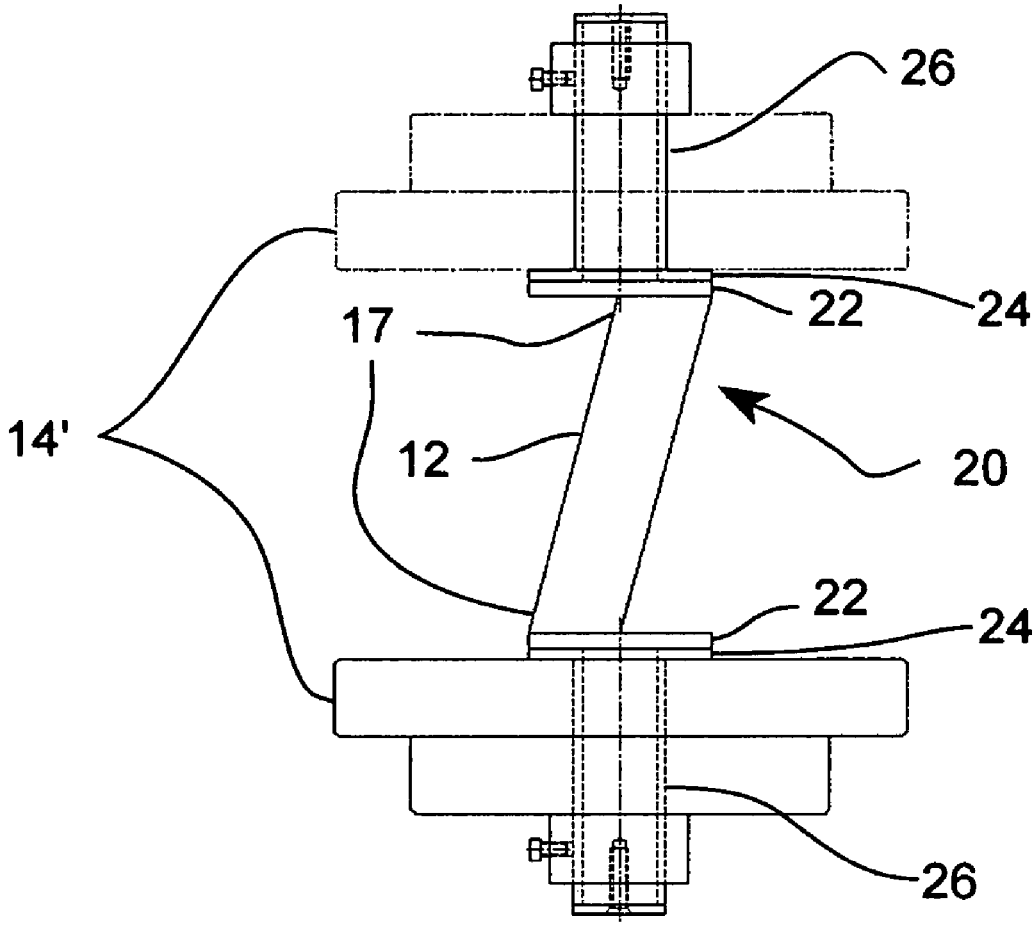

FIG. 4*a* Front view of the invention with swiveling bar assembly.

Figure 4B:
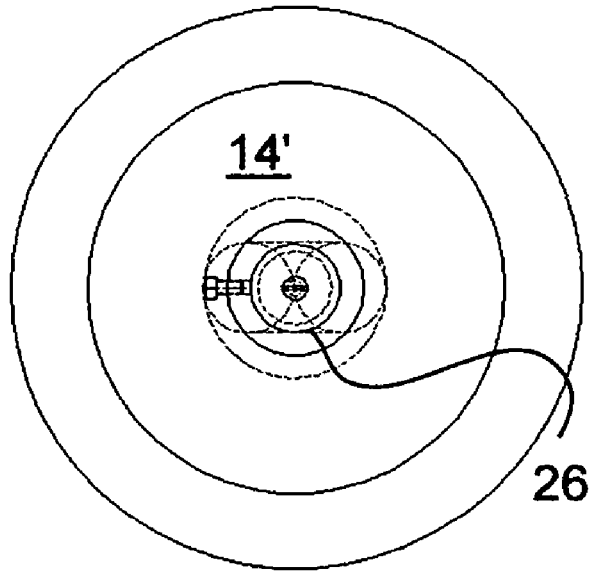

FIG. 4*b* Side view of the invention swiveling bar assembly.

DETAILED DESCRIPTION OF THE PREFERRED EMBODIMENT

FIGS. 1*a* and 1*b* show the differences between a dumbbell (10') of the prior art and a dumbbell with angled bar (10) wherein a bar (12) is set at an angle other than perpendicular in relation to the weights (14). There are two types of dumbbells, those with integral weights and those with releasably attached plates. In this description, the terms weights will be used to describe weights or plates interchangeably. The dumbbell with angled bar (10) improves the way a user can hold it without interfering with, as per FIG. 1*a*, the forearm (11) for example.

To make it easier for a user to always grab the dumbbell with angled bar (10) correctly, the weights (14) have a stabilizing element (15) which help the dumbbell with angled bar (10) rest stably on a surface. The stabilizing element (15) extends peripherally from at least one weight (14) in a configuration which turns the round shape of the weight (14) into a nearly to totally flat surface shape. The weights (14) can be of a larger diameter than conventional dumbbell weights (14') since the angle eliminates potential interference with forearms (11) as is the case with standard dumbbells (10') because the way a user holds them makes the weights (14') not parallel with the forearm (11), whereas in the case of dumbbell with angled bar (10), the weights (14) are parallel to the forearms (11) and as such, will never touch the forearm (11) no matter how large they are.

Because one side of the bar (12) is higher than the other side, there is a specific direction in which the dumbbell with angled bar (10) is to be grappled and to help in that matter, an indicia (16) is put either on the weight (14) or on the bar (12) in order to eliminate second guessing.

As described from FIG. 1 to FIG. 3 the invention appears to describe a proprietary dumbbell with proprietary designed weights (14) having offset holes (18) in the case of a dumbbell with interchangeable weights (14), in which case the bar (12) extends (dotted lines on FIG. 3*b*) beyond an elbow (13) to engage one or more weights (14) or in the case of a fixed weight dumbbell with no interchangeable weights (14) the bar (12) is integral with the weights (14).

In order to make use of generic weights (14'), a swiveling bar assembly (20) is shown in FIG. 4 in which ends (17) of the bar (12) do not connect with proprietary weights (14) but rather non proprietary weights (14') similar to those found in the prior art. In order to connect with the weights (14'), each end (17) of the bar (12) connects to a first member (22) and that first member is rotationally connected to a second member (24). The second member (24) has a rod (26) extending therefrom. The rod (26) is configured similar to a bar (12') of the prior art (or the dotted lines of FIG. 3*b*) and as such, can receive weights (14'). The rotational connection between the first member (22) and the second member (24) can be by way of ball bearings although any suitable rotational connector as are known in the art could provide the required rotational means. The bar (12) thus being able to rotate, the weights (14') do not require to have stabilizing elements (15) as described earlier but the bar (12) or the weights (14') can still make use of the indicia (16) as described earlier.

An obvious variation would be to have a bar (12) with elbows (13) as shown partially in dotted lines in FIG. 3 but used with non proprietary weights (14') which of course would have the dumbbell off kilter when laid on a flat surface but would still be usable for exercizing. Also, the means used for attaching removable weights (14') are similar to means known in the art.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Specification

FIGS. 1*a* and 1*b* show the differences between a dumbbell (10') of the prior art and a dumbbell with angled bar (10) wherein a bar (12) is set at an angle other than perpendicular in relation to the weights (14). There are two types of dumbbells, those with integral weights and those with releasably plates. In this description, the terms weights will be used to describe weights or plates interchangeably. The dumbbell with angled bar (10) improves the way a user can hold it without interfering with, as per FIG. 1*a*, the forearm (11) for example. This is so because, as shown in FIG. 1*b*, the weights on each side of the bar (12) are parallel in relation to each other while the bar is set at an angle. When a user grabs dumbbell with angled bar (10), the ergonomic mature of the bar (12) makes it so that the user holds the bar (12) as illustrated which has the weights (14) perpendicular to the floor and parallel to the forearm (11), and with the angle of the bar (12) best seen when looking along a plane that is perpendicular to the plane the forearm runs parallel to, perpendicular to the direction the forearm (11) takes the bar (12). Another way of stating the same thing is that the angle of the bar (12) is in a plane that runs parallel the plane the user's forearm.

Because one side of the bar (12) is higher than the other side, there is a specific direction in which the dumbbell with angled bar (10) is to be grappled and to help in that matter, an indicia (16) is put either on the weight (14) or on the bar (12) in order to eliminate second guessing.

As described from FIG. 1 to FIG. 3 the invention appears to describe a proprietary dumbbell with proprietary designed weights (14) having offset holes (18) in the case of a dumbbell with interchangeable weights (14), in which case the bar (12) extends (dotted lines on FIG. 3*b*) beyond an elbow (13) to engage one or more weights (14) or in the case of a fixed weight dumbbell with no interchangeable weights (14) the bar (12) is integral with the weights (14). The offset holes (18) are of course necessary for the bar (12) to be angled in relation to the weights (14) as more evidenced in FIG. 3*b* and are so located that they are not centered with the weights (14) as is normally found in dumbbells of the prior are such as per FIG. 2 and maintain all weights (14) parallel to each other.

The invention claimed is:

1. A dumbbell comprising:

an angled handle bar having first and second ends, a grasping portion between said first and second ends, said grasping portion having a longitudinal axis occupying a handle plane; and at least one first weight mounted to the first end of said angled handle bar and at least one second weight mounted to the second end of said angled handle bar, wherein each weight has a center point substantially bisected by the handle plane, wherein each weight has a weight plane that is substantially parallel to each other, and each weight plane is perpendicular to the handle plane, wherein the longitudinal axis of said angled handle bar intersects each weight plane at a non-perpendicular angle so that the longitudinal axis intersects said first weight at a first point at a first side of its center point and intersects said second weight at a second side of its center point that is diametrically opposite the first point, wherein a user's hand in a neutral wrist position may grasp the grasping portion of the angled handle bar such that the first end of the angled handle bar is further away from the user than the second end of the angled handle bar, the handle plane is substantially parallel to the user's forearm, and each weight plane is substantially parallel to the user's forearm, so that interference between the weights and the user's forearm is minimized during exercise movement.

2. A dumbbell as in claim 1, wherein said first weight comprises a plurality of first weights and said second weight comprises a plurality of second weights.

3. A dumbbell as in claim 1, wherein said first and second weights each have a hole offset from its center point for engaging said angled handle bar.

4. A dumbbell as in claim 1, wherein said first and second weights each have a hole at its center point for engaging said angled handle bar.

5. A dumbbell as in claim 1, wherein indicia is provided on the dumbbell to provide an indication to a user a direction to grasp said grasping portion of said angled handle bar.

6. A dumbbell as in claim 1, wherein said angled handle bar is a part of a swiveling bar assembly, wherein said first and second ends of said angled handle bar are each connected to a respective first member, each first member rotationally connected to a respective second member, and each second member having a respective rod extending therefrom;

wherein each said rod is configured to support at least one weight.

7. A dumbbell as in claim 6, wherein each respective rod has a rod axis and each rod axis is coaxial with the other rod axis.

8. A dumbbell as in claim 1, wherein said first and second ends of said angled handle bar each have a respective rod extending therefrom that is configured to support at least one weight.

9. A dumbbell as in claim 8, wherein each respective rod has a rod axis and each rod axis is parallel and offset from the other rod axis.

10. A dumbbell as in claim 1, wherein said first and second weights each comprise a stabilizing element extending peripherally to provide a flattened peripheral surface so that the dumbbell can stably rest on a support surface.

* * * * *